US005866504A

United States Patent [19]

Okada et al.

[11] Patent Number: 5,866,504

[45] Date of Patent: Feb. 2, 1999

[54] TRANSPARENT THERMOSENSITIVE RECORDING MATERIAL

[75] Inventors: Shinji Okada, Numazu; Motoo Tasaka, Susono, both of Japan

[73] Assignee: Ricoh Co., Ltd., Tokyo, Japan

[21] Appl. No.: 688,210

[22] Filed: Jul. 29, 1996

[30] Foreign Application Priority Data

| | | | |
|---|---|---|---|
| Jul. 28, 1995 | [JP] | Japan | 7-193332 |
| Nov. 14, 1995 | [JP] | Japan | 7-295453 |
| Jun. 14, 1996 | [JP] | Japan | 8-153919 |

[51] Int. Cl.[6] ..... B41M 5/36; B41M 5/40

[52] U.S. Cl. ..... 503/200; 427/152; 503/226

[58] Field of Search ..... 427/152; 503/200, 503/226

[56] References Cited

U.S. PATENT DOCUMENTS 5,380,693 1/1995 Goto ..... 503/200

*Primary Examiner*—Bruce H. Hess

*Attorney, Agent, or Firm*—Oblon, Spivak, McClelland, Maier & Neustadt, P.C.

[57] ABSTRACT

A transparent thermosensitive recording material compriser: (1) transparent substrate, (2) a thermosensitive coloring layer which is formed on one side of the transparent substrate, (3) a protective layer which is formed on the thermosensitive coloring layer and has almost the same refractive index as that of the thermosensitive coloring layer, and (4) an antistatic layer, formed on the protective layer and/or on the backside of the substrate, wherein the surface resistivity and the ten-point mean roughness of the antistatic layer are respectively smaller than $10^{10}$ Ω/□ and greater than 0.2 μm, and the coefficient of dynamic friction of the backside is greater than 0.2.

20 Claims, No Drawings

TRANSPARENT THERMOSENSITIVE RECORDING MATERIAL

BACKGROUND OF THE INVENTION

1. Field of the Invention

The present invention relates to a thermosensitive recording material which utilizes the color which forms as a result of the chemical reaction of a coloring agent, such as an electron donor, with a coloring developer, such as an electron acceptor, and more particularly to an improved transparent thermosensitive recording material, having excellent transparency and printing qualities which is used, for example, as a block copy sheet in gravure printing, offset printing and screen printing, as a transparent document sheet for OHP (over head projection), and as a transparent print output sheet for CAD (computer aided design).

2. Discussion of the Background

A thermosensitive recording material is well known in which a colored image is formed by the chemical reaction of a coloring agent, such as an electron donor, with a coloring developer, such as an electron acceptor, wherein color formation is induced when the coloring agent is subjected to heat and/or pressure, or the like.

The thermosensitive recording material has the following advantages over other conventional recording media;

(1) color images can be rapidly recorded by a relatively simple apparatus without the use of such complicated steps as development and fixing;

(2) color images can be recorded without producing noise and environmental pollution;

(3) various color images, for example, red, blue, violet and black, can be easily obtained;

(4) image density and background whiteness are high; and (5) the manufacturing cost is low.

Because of these advantages, the above described type of thermosensitive recording material can be widely used, not only as a recording material for price labels in stores, but also for copying documents and as print outputs for computers, facsimiles, automatic vending machines of labels and tickets, video printers and measuring instruments.

Recently, as the demand for thermosensitive recording materials continues to grow, thermosensitive recording materials are required to be useful for the document sheets for OHP, original sheets for diazo process reprography, print output sheets for CAD, and block copy sheets for gravure printing, offset printing and screen printing. In order to be useful in these areas, an improved thermosensitive recording material is desirable which has excellent transparency and print quality, which includes dimensional accuracy of a printed image. Japanese Laid-Open Pat. Applications Nos. 61-121875, 1-99873 and 64-90788 disclose transparent thermosensitive recording materials.

However, the known transparent thermosensitive recording materials have several shortcomings which include:

(1) the transparency of the materials is not sufficient to permit checking of several superimposed drawings printed on sheets of the transparent thermosensitive recording material; and (2) production costs are relatively expensive because of the complicated production process required in which a coating liquid for a thermosensitive coloring layer is prepared by emulsifying a microencapsuled coloring agent and a coloring developer which is dissolved in a water-insoluble or a hardly water-soluble organic solvent, and coated on a transparent substrate.

In attempting to improve these shortcomings, Japanese Laid-Open Pat. Application No. 5-104859 proposes an improved thermosensitive recording material which has excellent transparency and which is manufactured easily. However, the transparent thermosensitive recording material has shortcomings such as:

(1) the dimensional accuracy of a printed image is not satisfactory because of the slip between the thermosensitive recording material and feeding rollers during printing;

(2) mis-feeding, such as no-feeding or undesirable irregular feeding, of a transparent thermosensitive recording material occurs during printing by a thermal printer using a thermal printhead, because the transparent thermosensitive recording material is electrically charged, for example, by contact with feeding rollers in the thermal printer; and (3) an undesirable white spot image appears in the printed image, because the transparent thermosensitive recording material, which is charged, attracts dust thereon, and the heat for printing, which is applied by a thermal printhead, cannot be transferred to the thermosensitive coloring layer under or near the dust.

Japanese Laid-open Pat. Application No. 64-90788 discloses a transparent thermosensitive recording material including an antistatic layer. However, the transparent thermosensitive recording material cannot prevent charging of the material, particularly in a low humidity environment.

Because of these reasons, a need exists for a transparent thermosensitive recording material having excellent image quality such as high dimensional accuracy of the printed image, excellent transparency which permits checking of several superimposed drawings printed on the sheets of the transparent thermosensitive recording material, and excellent ability to prevent the charging which causes mis-feeding of sheets during printing and an undesirable which spot in a printed image.

SUMMARY OF THE INVENTION

Accordingly, one object of the present invention is to provide a transparent thermosensitive recording material, which has an excellent ability to prevent the charging which causes mis-feeding of sheets during printing and an undesirable which spot in a printed image under from low to high humidity conditions.

Another object of the present invention is to provide a transparent thermosensitive recording material, which has excellent feeding properties in a thermal printer so that an image having excellent dimensional accuracy can be printed.

Yet another object of the present invention is to provide a transparent thermosensitive recording material, which has excellent transparency such that it can be used to check several superimposed drawings printed on the sheets of the transparent thermosensitive recording material.

Still a further object of the present invention is to provide a transparent thermosensitive recording material, the printed image of which is resistant to abrasion, scratching, and sticking of printed sheets upon application of pressure thereto.

Briefly, these objects and other objects of the present invention as hereinafter will become more readily apparent can be attained by a transparent thermosensitive recording material comprising:

a transparent substrate;

a thermosensitive coloring layer, formed as an overlying layer on the transparent substrate, comprising a coloring agent, such as an electron donor, a coloring developer, such as an electron acceptor, which induces color formation in the coloring agent upon application of heat thereto, and a binder;

a protective layer, formed as an overlying layer on the thermosensitive coloring layer, which has almost the same refractive index as of the thermosensitive coloring layer; and an antistatic layer, formed as an overlying layer on the protective layer and/or the backside of the substrate, wherein the surface resistivity of the antistatic layer is smaller than about $10^{10}$ Ω/□ and the ten-point mean roughness Rz of the antistatic layer is greater than about 0.2 μm.

In an alternative embodiment, the coefficient of dynamic friction μS of the backside of the transparent thermosensitive recording material is greater than about 0.2.

In another embodiment, the antistatic layer comprises an electroconductive metal oxide and a binder.

In yet another embodiment, the average particle diameter of the electroconductive metal oxide is smaller than about 0.2 μm.

In a further embodiment, the binder of the antistatic layer includes polyester resin.

DETAILED DESCRIPTION OF THE PREFERRED EMBODIMENTS

The invention provides an improved transparent thermosensitive recording material comprising a transparent substrate, a thermosensitive coloring layer, a protective layer and an antistatic layer.

An important object of the present invention is to prevent the charging of a transparent thermosensitive recording material. This object is achieved by a thermosensitive recording material comprising an antistatic layer, the surface resistivity of which is smaller than about $10^{10}$ Ω/□. The antistatic layer is formed on at least one of the protective layer or the non-layered side of the substrate, and is preferably formed on the non-layered side of the substrate.

As to the selection of an antistatic agent, a plurality of antistatic agents is known conventionally. These agents are used for various purposes, and an appropriate antistatic agent for use can be selected. Antistatic agents are roughly classified into two types.

The first type of surface active agent is classified into anionic, cationic, nonionic and amphoteric surface active agents. Of these surface active agents, a cationic and an amphoteric surface active agent are preferred because each has the advantages of excellent ability to prevent charging, and excellent resistance against abrasion and scratching. Furthermore, these surface active agents are not expensive. However, the ability of these surface active agents to prevent charging tends to decrease in low humidity environments, because electroconductivity is acquired by absorbing moisture in the air.

The second type of antistatic agent is electroconductive metal oxides, which have high electroconductivity themselves, and have an excellent ability to prevent charging even in low humidity environments. These metal oxides are expensive, but an excellent ability to prevent charging is acquired even at low coating weight, which results in a recording material of excellent transparency and low manufacturing cost.

Suitable electroconductive metal oxides for use in the antistatic layer of the present invention include known electroconductive metal oxides such as $SnO_2$, $In_2O_3$, ZnO, $TiO_2$, MgO, $Al_2O_3$, BaO, $MoO_3$ and their compound oxides with P, Sb, Sn or Zn. However, the metal oxide is not limited to these oxides.

As to the average particle diameter of the electroconductive metal oxide, the smaller the average particle diameter becomes, the better the transparency of the antistatic layer. In order to achieve excellent transparency, the preferred average particle diameter of the electroconductive metal oxides in the antistatic layer of the present invention is smaller than about 0.2 μm.

Suitable binders used for binding the electroconductive metal oxide in the antistatic layer of the present invention include known resins such as, for example, water-soluble resins, aqueous emulsions, hydrophobic resins, ultraviolet crosslinking resins and electron beam crosslinking resins.

Specific examples of water-soluble resins include polyvinylalcohol, cellulose derivatives, casein, gelatin, styrene-maleic anhydride copolymer and carboxy-modified polyethylene.

Specific examples of aqueous emulsions and hydrophobic resins include polyvinyl acetate, polyurethane, vinylchloride-vinylacetate copolymer, polyester, polybutylacrylate, polyvinylbutyral, polyvinylacetal and ethylene-vinylacetate copolymer.

These resins may be employed individually or in combination, and, if desired, crosslinked by a crosslinking agent.

Suitable ultraviolet crosslinking resins for use in the present invention include any conventional ultraviolet crosslinking resin. For example, a monomer, an oligomer or a prepolymer which is capable of being polymerized and crosslinked by ultraviolet light can be employed.

Suitable electron beam crosslinking resins for use in the present invention include any conventional electron beam crosslinking resin. A branched polyester resin having five or more functional groups is preferably employed.

The preferred weight ratio of electroconductive metal oxide to binder is from about 0.05 to 2, and more preferably from about 0.2 to 1.5.

As stated above, an object of the invention is to provide a transparent thermosensitive recording material which has excellent feeding properties in order that printed images having high dimensional accuracy can be prepared. This objective is achieved by the transparent thermosensitive recording material of the invention which has a coefficient of dynamic friction μS on the backside of the transparent thermosensitive recording material of greater than about 0.2.

Another stated objective of the invention is to achieve resistance to sticking of printed images upon application of pressure thereto. The transparent thermosensitive recording material of the invention, which has a ten-point mean roughness Rz of the antistatic layer is greater than about 0.2 μm, achieves this objective.

Another objective as states it to prepare a transparent thermosensitive recording material having excellent transparency. This objective is achieved by a transparent thermosensitive recording material, in which the refractive index of each of the protective layer and the thermosensitive coloring layer is almost the same. Even when refractive indexes of the protective layer and the thermosensitive coloring layer are different, good transparency may be achieved, provided that these layers have uniform refractive indexes and thicknesses, namely, if the surfaces and the interfaces of each of these layers is smooth. However, in practice, it is almost impossible to satisfy these conditions, so that good transparency cannot be obtained. Furthermore, even when a protective layer and a thermosensitive coloring layer have uniform refractive indexes and thicknesses, if the refractive index of the protective layer, namely, the upper layer, is higher than that of the thermosensitive coloring layer, namely, the lower layer, the light projected from the protective layer tends to reflect at the interface of these layers, which reduces the transparency of the thermosensitive recording material. Accordingly, excellent transparency of a thermosensitive recording material can only be achieved when the refractive indexes of the protective layer and the thermosensitive coloring layer are designed to be almost the same.

Suitable coloring agents which can be used in the invention include electron donors. Any known colorless or pale-colored dye precursor conventionally used in thermosensitive recording materials can be employed individually or in a combination. For example, such leuco compounds as triphenylmethanephthalide, triallylmethane, fluoran, phenothiazine, thiofluoran, xanthene, indophthalyl, spiropyran, azaphthalide, chromenopyrazole, methine, rhodamineanilinolactam, rhodaminelactam, quinazoline, diazaxanthene and bislactone are preferably employed.

Specific examples of useful leuco dyes include, but are not limited to:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-ethylamino)fluoran,
2-anilino-3-methyl-6-(N-n-amyl-N-ethylamino)fluoran,
2-anilino-3-methyl-6-(N-n-isoamyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino-3-methyl-6-diethylaminofluoran,
2-(m-trifluoromethylanilino-3-methyl-6-(N-cyclohexyl-N-methylamino)fluoran,
2-(2,4-dimethylanilino-3-methyl-6-diethylaminofluoran,
2-(N-ethyl-p-toluidino-3-methyl-6-(N-ethylanilino)fluoran,
2-(N-methyl-p-toluidino-3-methyl-6-(N-propyl-p-toluidino) fluoran,
2-anilino-6-(N-n-hexyl-N-ethylamino)fluoran,
2-(o-chloroanilino)-6-diethylaminofluoran,
2-(o-bromoanilino)-6-diethylaminofluoran,
2-(o-chloroanilino)-6-dibutylaminofluoran,
2-(o-fluoroanilino)-6-dibutylaminofluoran,
2-(m-trifluoromethylanilino-6-diethylaminofluoran,
2-(p-acetylanilino-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino-6-(N-ethyl-p-toluidino)fluoran,
2-(α-phenylethylamino-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-methyl-2,4-dimethylanilino)fluoran,
2-dimethylamino-6-(N-methylanilino)fluoran,
2-dimethyiamino-6-(N-ethylanilino)fluoran,
2-diethylamino-6-(N-methyl-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran,
1,2-benzo-6-(N-ethyl-p-toluidino)fluoran,
2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-ethyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino)fluoran,
2-(α-phenylethylamino-4-methyl-6-diethylaminofluoran,
2-(p-toluidino-3-(t-butyl)-6-(N-methyl-p-toluidino)fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6dibutylaminofluoran,
2-dibenzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino (fluoran, 2-mesidino-4',5'-benzo-6-diethylaminofluoran,
2-(m-trifluoromethylanilino)-3-methyl-6-pyrrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenyl-methylamino)-6-pyrrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran, benzo leuco methyleneblue,
2-{3,6-bis(diethylamino)}-6-(o-chloroanilino) xanthylbenzoic acid lactam,
2-{3,6-bis(diethylamino)}-9-(o-chloroanilino) xanthylbenzoic acid lactam,
3,3-bis(p-dimethylaminophenyl)phthalide,
3,3-bis(p-dimethylaminophenyl)-6-dimethylamino-phthalide (Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3,6-bis(dimethylamino)fluorenespiro(9,3')-6'-dimethylaminophthalide,
6'-chloro-8'-methoxy-benzoindolino-spiropyran, and
6'-bromo-2'-methoxy-benzoindolino-spiropyran.

Suitable coloring developers which can be used in the present invention include known coloring developers such as the electron acceptors conventionally used in thermosensitive recording materials. They can be employed individually or in combination. Preferred coloring developers are the electron acceptors having a long chain alkyl group which are disclosed in, for example, Japanese Laid-open Pat. Application No. 5-124360, incorporated herein by reference. For example, organic phosphoric acid compounds, aliphatic carboxylic acid compounds, phenolic compounds, each including an aliphatic group having 12 or more carbon atoms, metal salts of mercaptoacetic acid including an aliphatic group having from 10 to 18 carbon atoms, alkyl esters of caffeic acid having an alkyl group having from 5 to 8 carbon atoms, and acidic esters of phosphoric acid having an aliphatic group having 16 or more carbon atoms are preferably employed. The above-mentioned aliphatic groups includes a linear alkyl group, a branched alkyl group, a linear alkenyl group and a branched alkenyl group, and may include a substituent of, for example, a halogen, an alkoxy group or an ester.

The coloring developers represented by the following formulas (I) and (II) are more preferred embodiments of the coloring developer of the present invention:

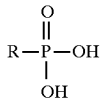

(I)

wherein R represents a linear alkyl group having 16 to 24 carbon atoms, and

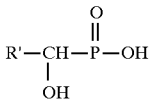

(II)

wherein R' represents a linear alkyl group having 13 to 23 carbon atoms.

The preferred content of the coloring developer in the composition is from about 1 to 20 parts by weight, more preferably from about 2 to 10 parts by weight per 1 part by weight of the coloring agent in the thermosensitive coloring layer.

Suitable binders for use in the thermosensitive coloring layer of the present invention include a resin containing a hydroxy or carboxy group. Specific examples of the resins include polyvinylacetal compounds such as polyvinylbutyral and polyvinylacetoacetal; cellulose compounds such as ethylcellulose, cellulose acetate, cellulose acetate propionate and cellulose acetate butyrate, and epoxy resins. However, the resins are not limited to these resins. The resins may be employed individually or in a combination.

The thermosensitive coloring layer of the present invention can be formed by the steps of, for example, preparing a coating liquid by dissolving or uniformly dispersing a coloring agent, a coloring developer and a binder in a organic solvent, coating the coating liquid on a transparent substrate by means of a conventional coating method, and then drying the coated liquid. The average particle diameter of coloring agent and coloring developer in the thermosensitive coloring layer is smaller than about 10 μm, preferably smaller than about 5 μm and more preferably smaller than about 1 μm. The dry thickness of the thermosensitive coloring layer, which depends on the formulation of the coating liquid and the application of the thermosensitive recording material, is preferably from about 1 to 50 μm, more preferably from about 3 to 20 μm.

The thermosensitive recording material may further include auxiliary agents which are employed in conventional thermosensitive recording materials to improve coating properties and printing qualities. These auxiliary agents are, for example, fillers, surface active agents, lubricants and agents which prevent coloring of the thermosensitive coloring layer upon application of pressure.

Specific examples of the filler include finely pulverized inorganic fillers such as calcium carbonate, silica, zinc oxide, titanium dioxide, aluminum hydroxide, barium sulfate, clay, kaolin, talc, surface-treated calcium carbonate and surface-treated silica, and finely-pulverized organic fillers such as urea-formaldehyde resin, styrene-methacrylic acid copolymer, polystyrene and polyvinylidenechloride.

Specific examples of the lubricant include higher fatty acid and esters, metal salts and amides thereof, and a variety of waxes such as animal waxes, vegetable waxes, mineral waxes and petroleum waxes.

The substrates for use in the present invention are preferably as follows but are not limited to:

polyester films such as polyethyleneterephthalate and polybutyleneterephthalate, cellulose films such as triacetatecellulose, polyolefin films such as polyethylene and polypropylene, polystyrene films, and films prepared by lamination of a plurality of above-mentioned films.

The thermosensitive recording material further includes a protective layer which overlies the thermosensitive coloring layer in order to improve the transparency of the thermosensitive recording material, the resistance of the printed image to light, chemicals, water, scratch and abrasion, and which prevents sticking of the thermosensitive recording material to thermal printheads.

A variety of resins can be employed to form the protective layer of the present invention. For example, water-soluble resins, water-insoluble resins including aqueous emulsion of such resins, ultraviolet crosslinking resins and electron beam crosslinking resins are preferably employed.

Specific examples of water-soluble resins are as follows:

polyvinylalcohol, modified polyvinylalcohol;

cellulose compounds such as methylcellulose, methoxycellulose and hydroxycellulose;

casein, gelatin, polyvinylpyrrolidone, styrene-maleic anhydride copolymer, diisobutylene-maleic anhydride copolymer, methylvinylether-maleic anhydride copolymer, polyacrylamide, modified polyacrylamide, polyvinylalcohol-acrylamide block copolymer, carboxy-modified polyethylene, melamine-formaldehyde resin and urea-formaldehyde resin.

Specific examples of the water-insoluble resins and aqueous emulsion resins are as follows:

polyvinyl acetate, polyurethane, styrene-butadiene copolymer, styrene-butadiene-acrylate copolymer, polyacrylic acid, polyacrylate, polybutyl methacrylate, vinyl chloride-vinyl acetate copolymer, polyvinylbutyral, polyvinylacetal, ethylcellulose, and ethylene-vinyl acetate copolymer.

The resins made by modifying the above-mentioned resins by a silicone-including group or segment are preferably employed.

These resins may be employed individually or in a combination, and, if desired, crosslinked by a crosslinking agent.

As the ultraviolet crosslinking resin for use in the present invention, any conventional ultraviolet crosslinking resin can be employed. A branched polyester resin having five or more functional groups and silicone-modified resin which is capable of crosslinking by electron beams are preferably employed.

The protective layer may further include a filler and/or a lubricant in an amount which keeps the surface of the protective layer smooth in order to obtain the excellent print quality and the excellent transparency of the thermosensitive recording material.

The filler which may be used in the protective layer of the present invention, which may be employed individually or as a combination of fillers include the known inorganic or organic pigments. A pigment whose oil absorption is greater than about 30 ml/100 g, more preferably greater than about 80 ml/100 g, is employed for the protective layer of the present invention. The preferred average particle diameter of the filler is smaller than about 0.3 $\mu$m.

Specific examples of the filler are as follows:

inorganic pigments
calcium carbonate,
silica,
zinc oxide,
titanium dioxide,
aluminum hydroxide,
zinc hydroxide,
barium sulfate,
clay,
talc,
surface treated calcium carbonate, and
surface treated silica.
inorganic pigments
urea-formaldehyde resin,
styrene-methacrylic acid copolymer,
and polystyrene.

The formation of the protective layer of the present invention can be achieved by the steps of, for example, preparing a coating liquid, coating the liquid on the thermosensitive coloring layer by means of a conventional coating method, and drying the coated liquid.

The dry thickness of the protective layer is preferably from about 0.1 to 20 $\mu$m, more preferably from about 0.5 to 10 $\mu$m. When the thickness of the protective layer is in the range of above-mentioned thickness, the advantages obtained are as follows:

(a) The resistance of image to light, chemicals, water, abrasion, and sticking to thermal printhead remains excellent;

(b) The thermosensitivity of the thermosensitive recording material remains fast; and (c) The manufacturing cost is not expensive.

The transparent thermosensitive recording material of the present invention can be employed in any conventional printing method such as, for example, those methods which employ a thermal pen, a thermal printhead or laser beams.

Having generally described this invention, a further understanding can be obtained by reference to certain specific examples which are provided herein for purposes of illustration only and are not intended to be limiting unless otherwise specified.

In the description of the following examples, the numbers are weight ratios unless otherwise specified.

EXAMPLES

Example 1

(Formation of Antistatic Layer)

The following components were mixed and dispersed, so that a Liquid A for an antistatic layer was prepared:

| (Liquid A) | |
|---|---|
| α-ethyl(trimethylammonium)alkanoylester (SAT-5, manufactured by NIHON JUNYAKU Co.) | 10 |
| polyethylene beads (Flow Beads LE-1080, manufactured by SEITETSU KAGAKU CO.) | 1 |
| methanol | 89 |

Liquid A was coated on one side of a PET film of 75 $\mu$m thick, and dried at 60° C. for 2 minutes to form an antistatic layer of 0.5 $\mu$m in dry thickness.

(Formation of Thermosensitive Coloring Layer)

A mixture of the following compounds was pulverized and dispersed in a ball mill such that the solid components, in the liquid phase, had an average particle diameter of 0.3 $\mu$m.

Liquid B for preparation of the thermosensitive coloring layer was prepared:

| (Liquid B) | |
|---|---|
| 3-diethylamino-6-methyl-7-anilinofluoran | 4 |
| octadecyl phosphonate | 12 |
| polyvinyl butyral (Denka Butyral #3000-2, manufactured by Denki Kagaku Kogyo Co.) | 6 |
| Toluene | 57 |
| methyl ethyl ketone | 57 |

Liquid B was coated on the opposite side of the antistatic layer of the previously prepared PET film, and dried to form a thermosensitive coloring layer of 9 μm in dry thickness.

(Formation of Protective Layer)

The following components were mixed to prepare a Liquid C for a protective layer:

| (Liquid C) | |
|---|---|
| silicone-modified acrylic resin (amount of solids of 30%; US-350, manufactured by Toa Gosei Chemical Industry Co.) | 35 |
| methyl ethyl ketone | 115 |

Liquid C was coated on the thermosensitive coloring layer of the previously prepared PET film having antistatic and thermosensitive coloring layers, and dried to form a protective layer of 3 μm in dry thickness. Thus a transparent thermosensitive recording material was obtained.

Comparative Example 1

(Formation of Thermosensitive Coloring Layer and Protective Layer)

Liquid B was coated on one side of a PET film 75 μm thick, and dried to form a thermosensitive coloring layer 9 μm in dry thickness.

The procedures for preparation of the protective layer in Example 1 were repeated, so that a transparent thermosensitive recording material without an antistatic layer was obtained.

Example 2

(Formation of Antistatic Layer)

The following components were mixed and dispersed to prepare a Liquid D for an antistatic layer:

| (Liquid D) | |
|---|---|
| α-ethyl(trimethylammonium)alkanoylester (SAT-5, manufactured by NIHON JUNYAKU Co.) | 10 |
| fine powder of silica (P-527, manufactured by Mizusawa Chemical Ind. Co.) | 1 |
| methanol | 89 |

Liquid D was coated on one side of a PET film 75 μm thick, and dried at 60° C. for 2 minutes to form an antistatic layer of 0.5 μm in dry thickness.

(Formation of Thermosensitive Coloring Layer and Protective Layer)

The procedures for preparation of the thermosensitive coloring layer and the protective layer in Example 1 were repeated, so that a transparent thermosensitive recording material was obtained.

Example 3

(Formation of Antistatic Layer)

The following components were mixed and pulverized to the extent that the average particle diameter of the solid component in the liquid phase became 1 μm. Liquid E for formation of an antistatic layer was thereby prepared:

| (Liquid E) | |
|---|---|
| Finely-pulverized powder of $SnO_2$-Sb (TL21, manufactured by CATALYSTS & CHEMICALS Co.) | 12 |
| polyester resin (Vylon RV-200, manufactured by TOYOBO Co.) | 8 |
| methyl ethyl ketone | 80 |

Liquid E was coated on one side of a PET film 75 μm thick, and dried at 100° C. for 2 minutes to form an antistatic layer 0.5 μm in dry thickness.

(Formation of Thermosensitive Coloring Layer and Protective Layer)

The procedures of preparation of the thermosensitive coloring layer and the protective layer in Example 1 were repeated, so that a transparent thermosensitive recording material was obtained.

Example 4

(Formation of Antistatic Layer)

The following components were mixed and dispersed to prepare a Liquid F for preparation of an antistatic layer:

| (Liquid F) | |
|---|---|
| $SnO_2$-P compound oxide/polyvinyl chloride (amount of solids of 25%, average particle diameter is 0.14 μm; P-3519, manufactured by CATALYSTS & CHEMICALS IND. CO.) | 20 |
| methyl ethyl ketone | 80 |

Liquid F was coated on one side of a PET film 75 μm thick, and dried at 110° C. for 2 minutes to form an antistatic layer 0.3 μm in dry thickness.

(Formation of Thermosensitive Coloring Layer and Protective Layer)

The procedures for preparation of the thermosensitive coloring layer and the protective layer in Example 1 were repeated, so that a transparent thermosensitive recording material was obtained.

Example 5

(Formation of Antistatic Layer)

The following components were mixed and dispersed to prepare a Liquid G for the preparation of an antistatic layer:

| (Liquid G) | |
|---|---|
| $SnO_2$-Sb compound oxide/polyester resin (amount of solids of 25%, average particle diameter is 0.15 μm; Colcoat SP-2002, manufactured by COLCOAT Co.) | 20 |
| water | 80 |

Liquid G was coated on one side of a PET film 75 μm thick, and dried at 100° C. for 2 minutes to form an antistatic layer 0.3 μm in dry thickness.

(Formation of Thermosensitive Coloring Layer and Protective Layer)

The procedures of preparation of the thermosensitive coloring layer and the protective layer in Example 1 were repeated, so that a transparent thermosensitive recording material was obtained.

Example 6

(Formation of Thermosensitive Coloring Layer and Protective Layer)

Liquid B was coated on one side of a PET film of 75 μm thick, and dried to form a thermosensitive coloring layer of 9 μm in dry thickness.

Liquid C was coated on the thermosensitive coloring layer of the previously prepared PET film, and dried to form a protective layer 3 μm in dry thickness.

Liquid G was coated on the protective layer of the previously prepared PET film with the thermosensitive coloring and protective layers, and dried to form an antistatic layer 0.5 μm in dry thickness.

Each of the transparent thermosensitive recording materials of the present invention in Examples 1 through 6 and Comparative Example 1 was subjected to a plurality of tests and evaluations, each of which is described as follows:

(1) Measurements of the surface resistivity were carried out with a surface resistivity meter, High Resistance Meter 4329A from Hewlett Packard, under the environmental conditions of 5° C. 30% RH. The applied voltage was 10 volts, and the surface resistivity was calculated by the electric current after one minute from the start of application of the voltage. The size of the sample for the test was 10 cm×10 cm.

(2) Measurements of the ten-point mean roughness Rz were carried out with a surface roughness waveness measuring instrument SE-3A manufactured by Kosaka Laboratory Ltd.

(3) Measurements of coefficient of dynamic friction were carried out with an automatic friction abrasion analyzer DF PM-SS manufactured by Kyowa Interface Science Co.

(4) Feeding tests were carried out with a thermal printing simulator, manufactured by Ookura Electric Co. An image of 120 mm long was printed on each of the transparent thermosensitive recording materials and the actual lengths of the printed images were measured with a metal rule. The closer to 120 mm the actual length of the printed image became, the better the feeding property of the transparent thermosensitive recording material.

(5) The presence of an undesirable white spot or white streak image was also checked for in each solid-developed image printed by the thermal printing simulator at 5° C. 30% RH. The classifications are as follows:

0: Neither white spot nor white streak was observed in the printed image.

Δ: One or two white spots or streaks were observed in the printed image.

X: Three or more white spots or streaks were observed in the printed image.

(6) Measurements of the haze of the transparent thermosensitive recording materials were carried out with a direct reading haze meter manufactured by Toyo Seiki Co. The size of the sample for the test was 50 mm×50 mm.

(7) Sticking tests were carried out by the following methods:

(a) A test sample by which two sheets of a transparent thermosensitive recording material 30 mm long and 70 mm wide were superimposed on each other so that the protective layer contacted the backside of the other sheet;

(b) The test sample was set between two slide glasses each 30 mm long and 70 mm wide;

(c) The test sample covered by slide glasses was placed in a pressing machine and allowed to stand at 40° C. for 16 hours under the pressure of 3 kg/cm$^2$; and (d) After standing for 16 hours, the two sheets of the test sample were peeled off and then evaluated as follows:

Rank 5: There was no trace of sticking of the test sample.

Rank 4: The two sheets of the test sample slightly stuck to each other, but the coated layers were not broken.

Rank 3: The two sheets of the test sample stuck to each other and the coated layers were not broken.

Rank 2: The two sheets of the test sample stuck to each other and the coated layers were partially broken by peeling.

Rank 1: The two sheets of the test sample stuck to each other and the coated layers were almost broken by peeling.

(8) Measurements of the layer adhesion of the antistatic layer to the substrate were carried out by the cross-cut test method based on JIS K540001900. The size of the sample for the test was 80 mm×150 mm. The evaluation of the layer adhesion was carried out by the following classification system.

Grade 10: All cut lines were sharp, and all cross points of the cut lines and cut pieces of the antistatic layer were not removed by peeling of the tape.

Grade 8: The cross points of the cut lines slightly peeled and the cut pieces of the antistatic layer had not peeled off. The ratio of the peeled area to all of the tested area was smaller than or equal to 5%.

Grade 6: Both sides and the cross points of the cut lines had peeled off. The ratio of the peeled area to all of the tested area was greater than 5% and smaller than 15%.

Grade 4: Both sides and the cross points of the cut lines had fairly peeled off. The ratio of the peeled area to all of the tested area was greater than 15% and smaller than 35%.

Grade 2: Both sides and the cross points of the cut lines had peeled off in an area greater than that of the Grade 4. The ratio of the peeled area to all of the tested area was greater than 35% and smaller than 65%.

Grade 0: The ratio of the peeled area to all of the tested area was greater than 65%.

The results are shown in Table 1.

TABLE 1

| | Surface Resistivity (Ω/□) | Surface Roughness Rz (μm) | μS* | Feeding Property (mm) | White Spots | Haze (%) | Sticking (rank) | Layer Adhesion Grade |
|---|---|---|---|---|---|---|---|---|
| Example 1 | $1.2 \times 10^9$ | 0.60 | 0.10 | 115 | ○ | 32 | 5 | 6 |
| Example 2 | $9.4 \times 10^7$ | 0.58 | 0.24 | 117 | ○ | 30 | 5 | 4 |
| Example 3 | $7.5 \times 10^7$ | 0.70 | 0.30 | 120 | ○ | 25 | 5 | 8 |
| Example 4 | $4.8 \times 10^7$ | 0.40 | 0.43 | 120 | ○ | 15 | 5 | 6 |
| Example 5 | $3.2 \times 10^7$ | 0.43 | 0.41 | 120 | ○ | 15 | 5 | 10 |
| Example 6 | $3.2 \times 10^7$ | 0.45 | 0.37 | 120 | ○ | 15 | 5 | 10 |
| Comparative Example 1 | $2.1 \times 10^{12}$ | 0.10 | 0.37 | 112 | X | 13 | 2 | 10 |

*Coefficient of dynamic friction

The results in the Table 1 clearly indicate that the transparent thermosensitive recording material of the present invention exhibits such characteristics as excellent feeding qualities even in low humidity, excellent image quality without the presence of undesirable white spots, excellent resistance to sticking, and excellent transparency.

Having now fully described the invention, it will be apparent to one of the ordinary skill in the art that many changes and modifications can be made thereto without departing from the spirit or scope of the invention as set forth herein.

This invention is based on Japanese Patent Application 07-193332 filed on Jul. 28, 1995, 07-295453 filed on Nov. 14, 1995, and 08-153919 filed on Jun. 14, 1996, each incorporated herein by reference.

What is claimed as new and desired to be secured by letters patent of the United States is:

1. A transparent thermosensitive recording material comprising:

a transparent substrate;

a thermosensitive coloring layer which is formed on one side of said substrate and comprising a coloring agent, a coloring developer which induces color formation in said coloring agent upon application of heat thereto, and a binder;

a protective layer which is formed on said thermosensitive coloring layer and has almost the same refractive index as that of said thermosensitive coloring layer; and an antistatic layer, formed on at least one of the protective layers or the non-layered side of said substrate, wherein the surface resistivity of said antistatic layer is smaller than about $10^{10}$ Ω/□ and the ten-point mean roughness Rz is greater than about 0.2 μm.

2. The transparent thermosensitive recording material of claim 1, wherein the coefficient of dynamic friction μs of the non-layered side of the substrate layer, optionally provided with an antistatic layer, is greater than about 0.2.

3. The transparent thermosensitive recording material of claim 2, wherein said antistatic layer comprises an electroconductive metal oxide and a binder.

4. The transparent thermosensitive recording material of claim 3, wherein the average particle diameter of said electroconductive metal oxide is smaller than about 0.2 μm.

5. The transparent thermosensitive recording material of claim 3, wherein said binder in said antistatic layer comprises a polyester resin.

6. The transparent thermosensitive recording material of claim 3, wherein the weight ratio of said metal oxide to said binder in said antistatic layer is from about 0.2 to 1.5.

7. The transparent thermosensitive recording material of claim 1, wherein said antistatic layer comprises an electroconductive metal oxide and a binder.

8. The transparent thermosensitive recording material of claim 7, wherein the average particle diameter of said electroconductive metal oxide is smaller than about 0.2 μm.

9. The transparent thermosensitive recording material of claim 7, wherein said binder in said antistatic layer comprises a polyester resin.

10. The transparent thermosensitive recording material of claim 7, wherein the weight ratio of said metal oxide to said binder in said antistatic layer is from about 0.2 to 1.5.

11. The transparent thermosensitive recording material of claim 1, wherein said coloring developer comprises at least one of following compounds (I) and (II);

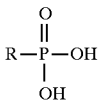

(I)

wherein R represents a linear alkyl group having from 16 to 24 carbon atoms, and

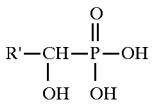

(II)

wherein R' represent a linear alkyl group having from 13 to 23 carbon atoms.

12. The transparent thermosensitive recording material of claim 1, wherein said binder in said thermosensitive coloring layer comprises a resin comprising a hydroxy or carboxy group.

13. The transparent thermosensitive recording material of claim 1, wherein the thickness of said thermosensitive coloring layer is from about 3 to 20 μm.

14. The transparent thermosensitive recording material of claim 1, wherein said protective layer further comprises a filler.

15. The transparent thermosensitive recording material of claim 14, wherein the oil absorption of said filler is greater than about 80 ml/100 g.

16. The transparent thermosensitive recording material of claim 1, wherein the thickness of said protective layer is from about 0.5 to 10 μm.

17. The transparent thermosensitive recording material of claim 16, wherein said protecting layer contains a filler having an average particle diameter of less than about 0.3 μm.

18. The transparent thermosensitive recording material of claim 17, wherein the filler is an inorganic or organic pigment.

19. The transparent thermosensitive recording material of claim 1, wherein the weight ratio of said coloring developer to coloring agent is from about 2 to 10.

20. The transparent thermosensitive recording material of claim 1, wherein the coloring agent is an electron donor and the coloring developer is an electron acceptor.

* * * * *